US007074085B2

(12) United States Patent
Chen

(10) Patent No.: US 7,074,085 B2
(45) Date of Patent: Jul. 11, 2006

(54) SHIELDED ELECTRICAL CONNECTOR ASSEMBLY

(75) Inventor: Ming-Ching Chen, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/234,543

(22) Filed: Sep. 23, 2005

(65) Prior Publication Data

US 2006/0063432 A1 Mar. 23, 2006

(51) Int. Cl.
*H01R 13/648* (2006.01)

(52) U.S. Cl. ..... 439/607; 439/108; 439/569; 439/660

(58) Field of Classification Search ..... 439/607, 439/108, 566, 569, 570, 876, 660
See application file for complete search history.

(56) References Cited

U.S. PATENT DOCUMENTS 5,697,799 A 12/1997 Consoli et al.
5,876,247 A 3/1999 Hashimoto
5,921,814 A 7/1999 Maruyama
6,464,515 B1 * 10/2002 Wu ..... 439/108
6,551,139 B1 * 4/2003 Yu ..... 439/607
6,558,195 B1 * 5/2003 Kusuhara ..... 439/607
6,702,615 B1 * 3/2004 Fan ..... 439/607
6,726,492 B1 * 4/2004 Yu ..... 439/108

* cited by examiner

*Primary Examiner*—Hien Vu
(74) *Attorney, Agent, or Firm*—Wei Te Chung

(57) ABSTRACT

An electrical connector for mounting on a circuit board includes an insulative housing (11) having a pair of side walls (113), a pair of end walls (114) and defining a mating opening (115), and a mounting face and a number of contact receiving slots (112); a plurality of contacts (12) received in the contact receiving slots and each having a soldering portion (125) extending along the mounting face for surface mounting on the circuit board; a pair of shielding plates (13) each having a main portion (132) located outside tail ends of the soldering portion, a bent portion (131) bent from opposite ends of the main potion and attached to the end walls and a grounding pad (135) extending along the mounting face for surface mounting on the circuit board.

5 Claims, 8 Drawing Sheets

SHIELDED ELECTRICAL CONNECTOR ASSEMBLY

BACKGROUND OF THE INVENTION

1. Field of the Invention

The present invention relates to an electrical connector assembly, and more particularly to a shielded electrical connector assembly for connecting two circuit boards.

2. Description of Related Art

A variety of electrical connector assemblies have been used to establish electrical connection between two separate circuit boards. The electrical connector assembly generally includes a plug connector mateable with a receptacle connector.

U.S. Pat. No. 5,697,799 discloses a receptacle connector mating with a plug connector comprising a housing, a plurality of contacts mounted in the housing and a shell surrounding the housing. Solder tails of outer rows of contacts extend outwardly of side walls of the housing and side walls of the shell for soldering to a circuit board. However, the contacts are not absolutely shielded by the shell, therefore, under high frequency operations, electromagnetic interference (EMI) may cause adverse influence to the signal transmission. To reduce the electromagnetic interference, U.S. Pat. No. 5,876,247 provides a shielded connector having a pair of substantially C-shaped metal shielding plates each having housing-engaging projections for elastically engaging with corresponding inside surfaces of the housing. However, since contacts and shielding plates of the shielded connector are inserted into holes of a circuit board and soldered therein in the direction vertical to the surface of the circuit board, but this type of shielding plate can not be applied to a surface mountable electrical connector requiring that soldering portions of the contacts should extend along the surface of the circuit board. Furthermore, a contact embossment is further provided on the shielding plate to cooperate with a corresponding housing-engaging projections to retain the shielding plate in the housing, thus making the shielding plate more complicated.

It is thus desired to provide a shielded electrical connector assembly to overcome the shortcomings described above.

SUMMARY OF THE INVENTION

An object of the present invention is to provide an electrical connector assembly having superior shielding characteristics.

Another object of the present invention is to provide an electrical connector assembly being assembled easily.

In order to achieve above-mentioned object, an electrical connector for mounting on a circuit board includes an insulative housing having a pair of side walls, a pair of end walls and defining a mating opening, a mounting face and a number of contact receiving slots; a plurality of contacts received in the contact receiving slots and each having a soldering portion extending along the mounting face for surface mounting on the circuit board; a pair of shielding plates each having a main portion being located outside tail ends of the soldering portion, a bent portion bent from opposite ends of the main potion and attached to the end walls and a grounding pad extending along the mounting face for surface mounting on the circuit board.

Other objects, advantages and novel features of the present invention will become more apparent from the following detailed description of the present embodiment when taken in conjunction with the accompanying drawings.

DETAILED DESCRIPTION OF THE INVENTION

Figure 1:
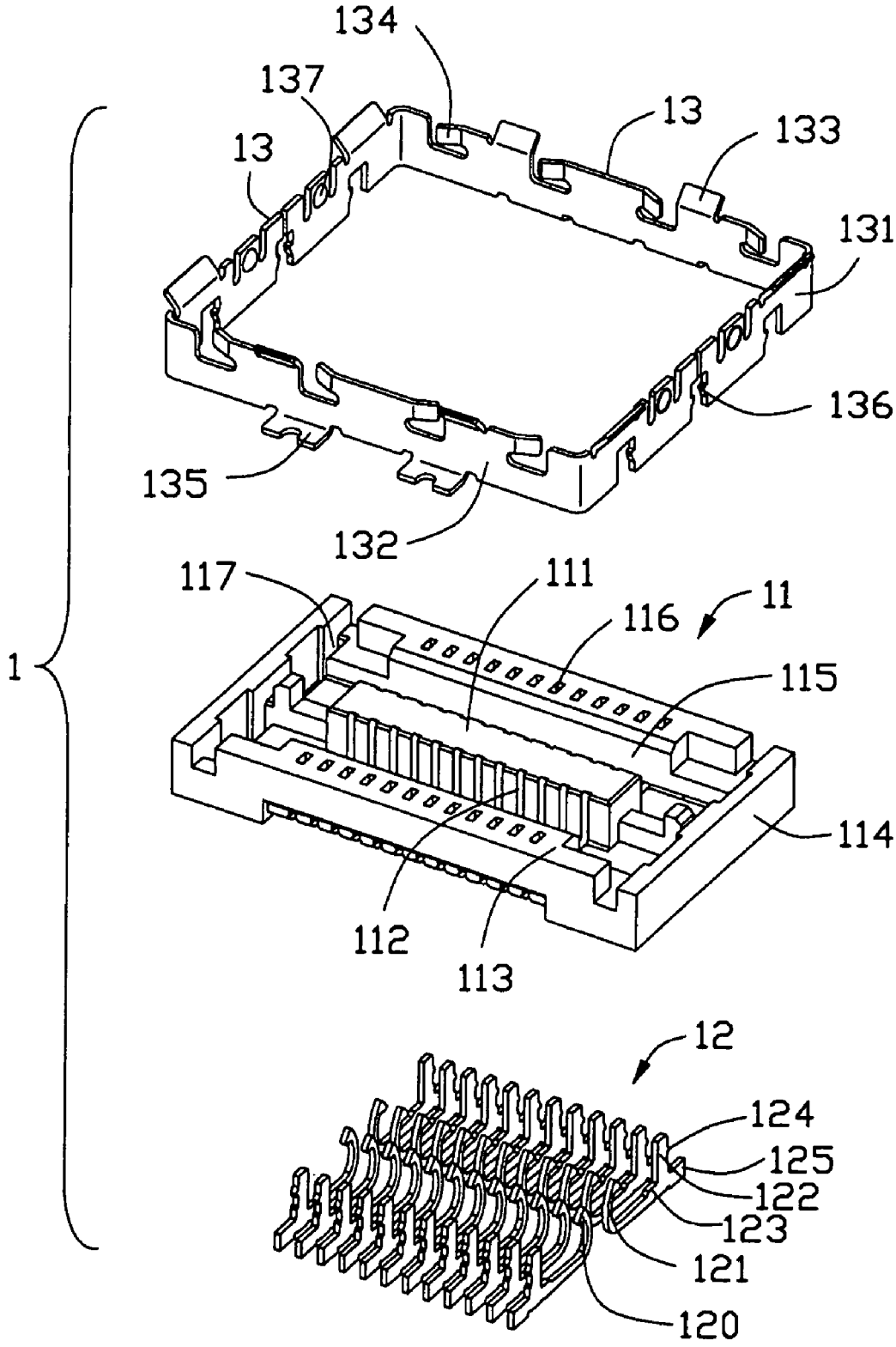
FIG. 1 is an exploded perspective view of a receptacle connector according to the present invention.

Reference will now be made to the drawing figures to describe the preferred embodiment of the present invention in detail.

Figure 4:
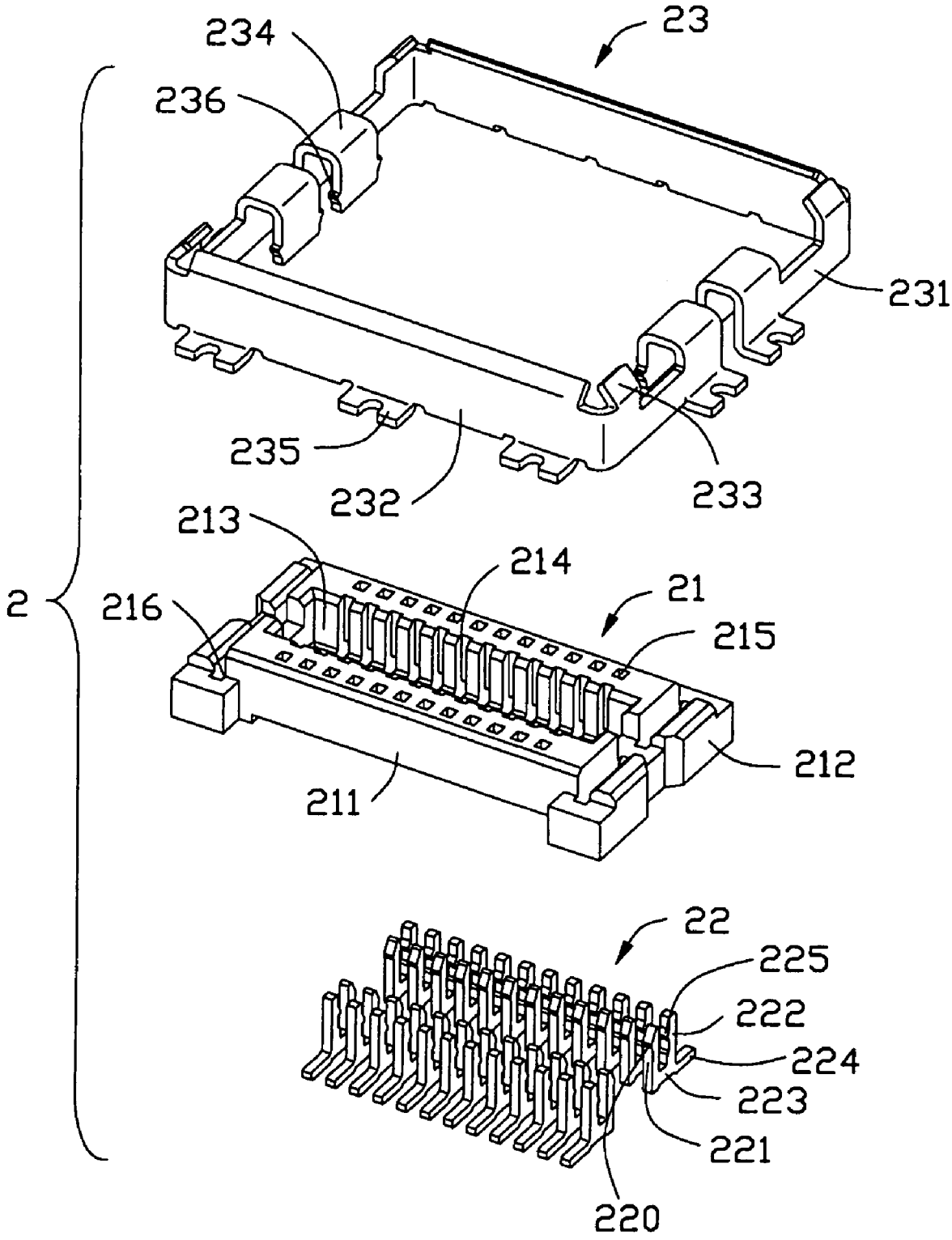
FIG. 4 is an exploded perspective view of a plug connector.
Figure 5:
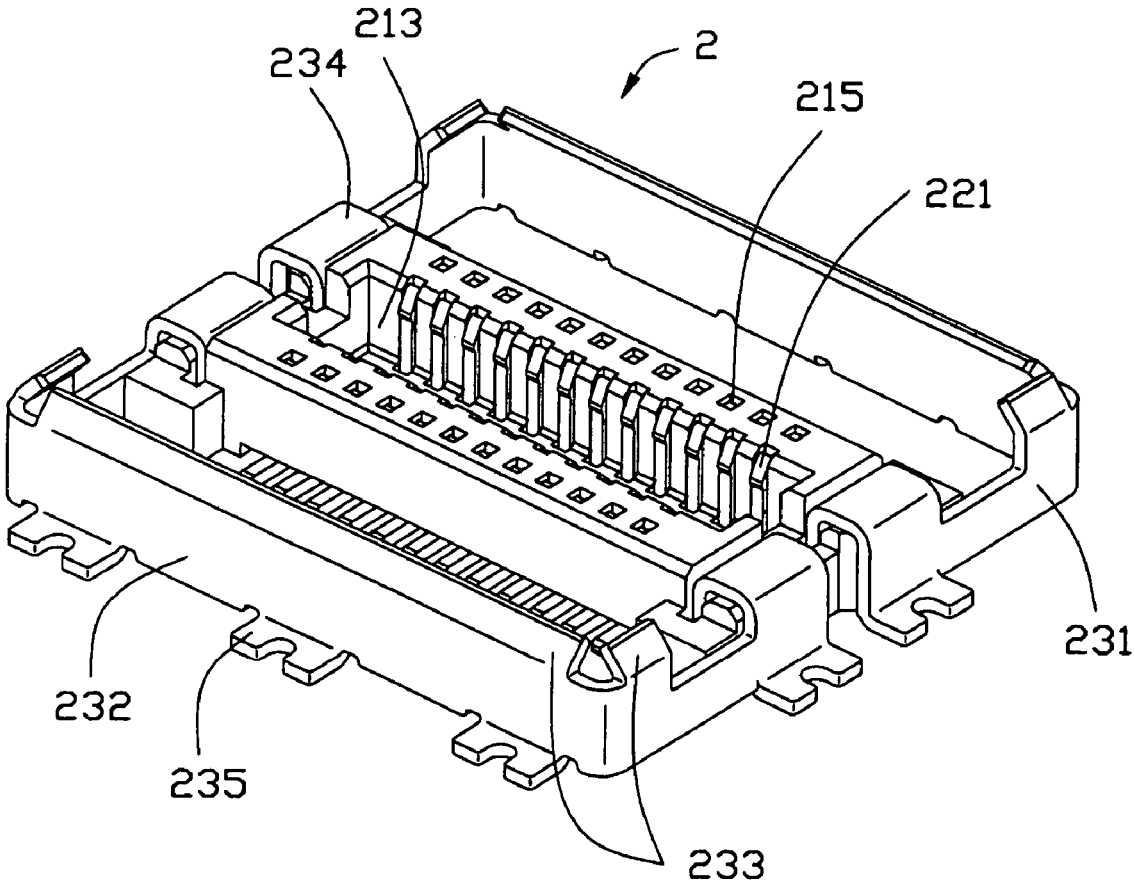
FIG. 5 is an assembled perspective view of the plug connector of FIG. 4.
Figure 8:
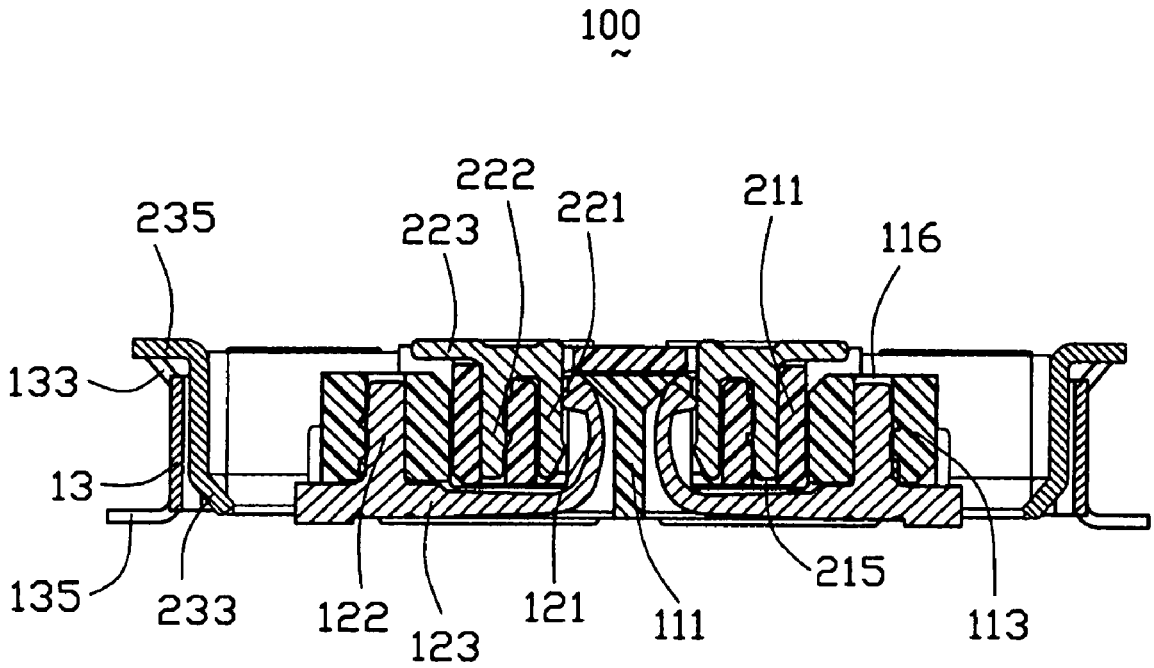
FIG. 8 is a cross-section view of the electrical connector assembly taken along line 8—8 of FIG. 7.

Referring to FIGS. 1, 4 and 8, an electrical connector assembly 100 in accordance with the present invention comprises a receptacle connector 1 and a mating plug connector 2, the receptacle connector 1 is mounted on one circuit board (not shown), and the plug connector 2 is mounted on the other circuit board (not shown). The receptacle connector 1 and the plug connector 2 are mated together to establish a connection between two circuit boards.

Figure 2:
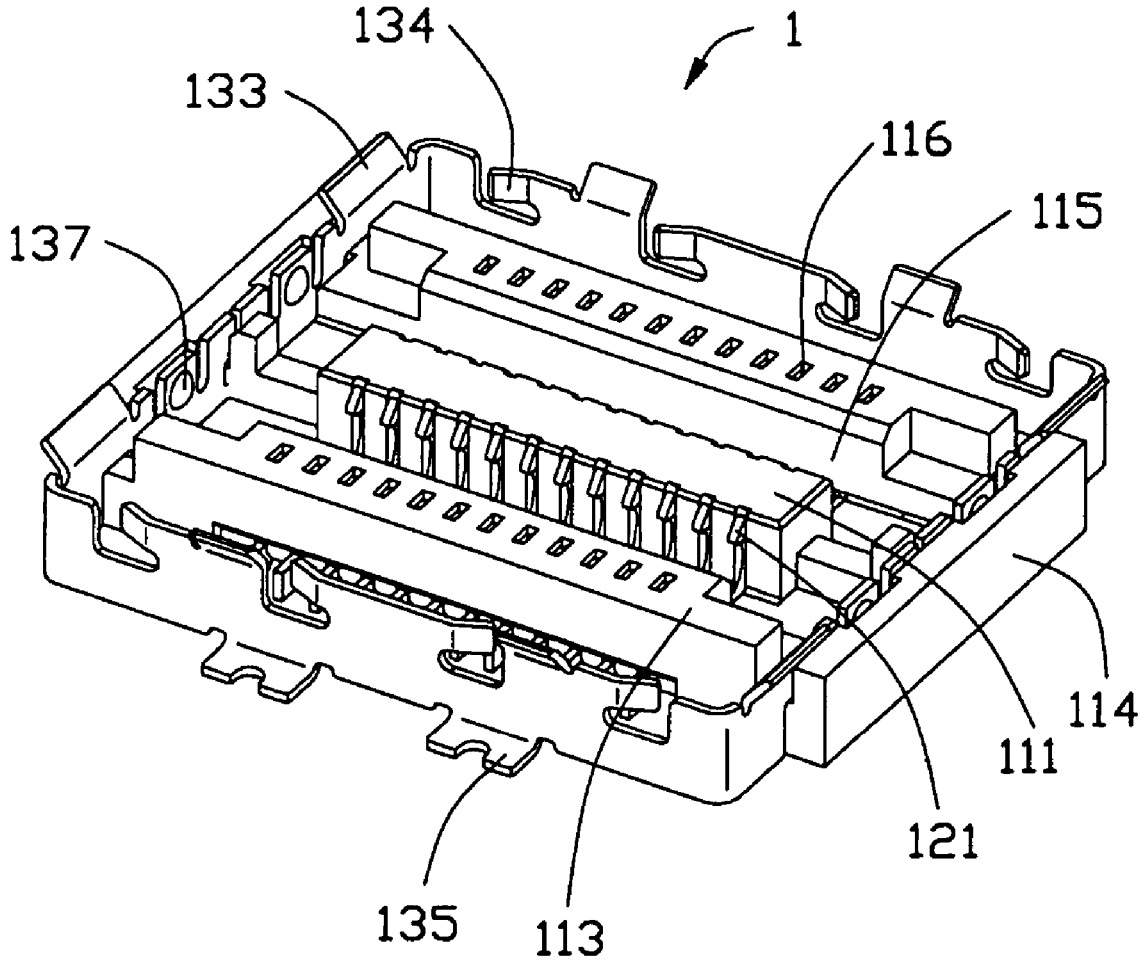
FIG. 2 is an assembled perspective view of the receptacle connector of FIG. 1.
Figure 3:
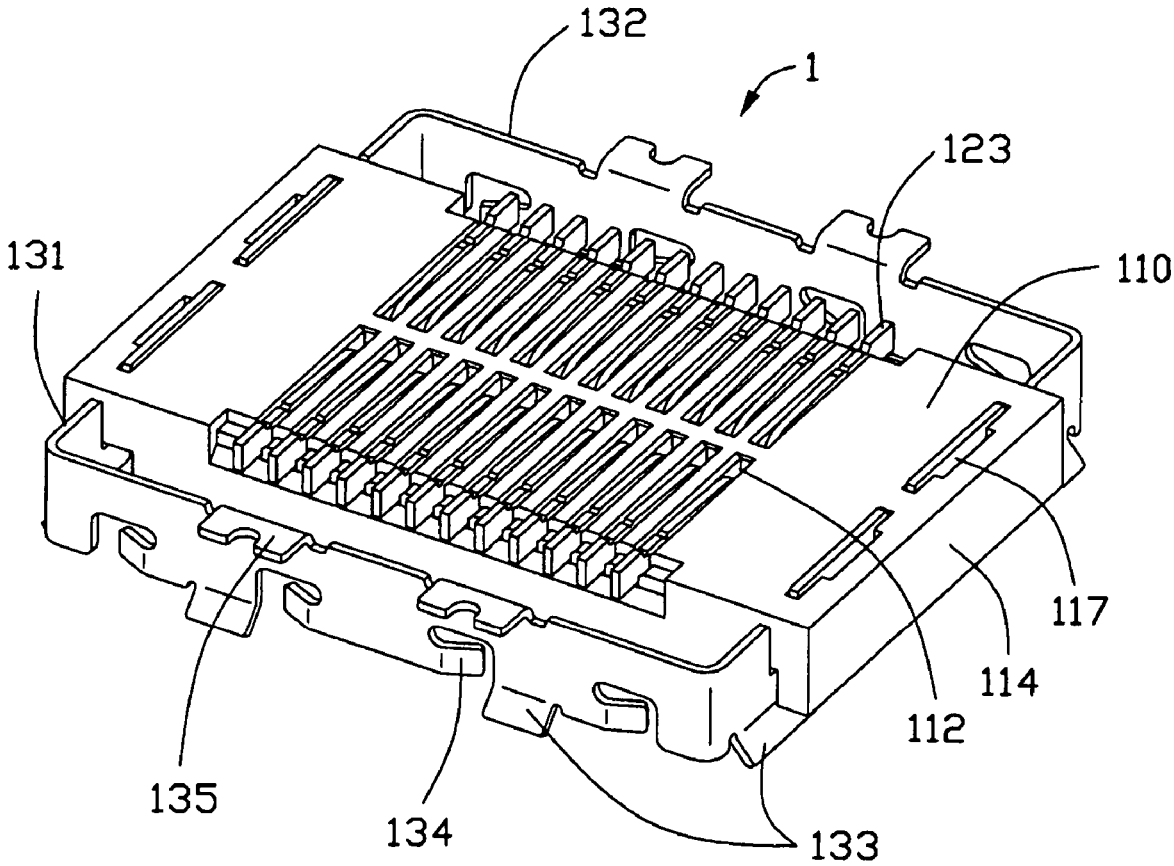
FIG. 3 is an assembled perspective view of the receptacle connector of FIG. 1 taken from another aspect.

Referring to FIGS. 1–3, the receptacle connector 1 includes an insulative housing 11 and a plurality of conductive contacts 12 arranged at regular intervals along the length of the housing 11, the contacts 12 are arranged in two arrays and fixed to the housing 11. The housing 11 has a rectangular central portion 111, a pair of side walls 113, and a pair of opposite end walls 114 surrounding the central portion 111, and defines a mating opening 115 therebetween in which a corresponding portion of the plug connector 2 is received. A plurality of receiving slots 112 extending to a bottom surface 110 of the housing 11 are formed at regular intervals lengthwise along opposing sides of the central portion 111.

Each contact 12 includes a horizontal base portion 123, a contacting portion 121 extending upwardly from one end of the base portion 123, a retaining portion 122 rising from the base portion 123 at a substantially middle portion thereof and a soldering portion 125 extending generally horizontally from the other end of the base portion 123 for surface mounting to the circuit board. A barb 124 is formed on one edge of the retaining portion 122 for retaining the contacts 12 in the housing 11.

The housing 11 further has a plurality of contact mounting holes 116 formed in the side walls 113 thereof for accommodating the retaining portions 122. The mounting holes 116 are preferably aligned with contact-receiving slots 112. The contacts 12 are inserted into the slots 112 form the bottom surface 110 of the receptacle connector 1 with the barbs 124 engaging with inner surfaces of the mounting holes 116 to retain the contacts 12 in the housing 11. Meanwhile, the soldering portions 125 extend outwardly of the side walls 113 for soldering to the circuit board, free ends 120 of the contacting portions 121 extend into the mating opening 115 to contact with contacts 22 of the plug connector 2.

A pair of U-shaped shielding plates 13 having substantially the same shapes and dimensions are attached to the housing 11. The shielding plates 13 has a main portion 132 and side portions 131 bent at right angle from opposite ends of the main portion 132. The shielding plates 13 further include a number of lead-in tabs 133 extending outwardly for easing insertion of the plug connector 2 into the receptacle connector 1. The main portion 132 has a plurality of resilient fingers 134 protruding inwardly from upper edges thereof for abutting against shielding plates 23 of the plug connector 2. The detailed description of the shielding plates 23 of the plug connector 2 will be provided hereinafter. A plurality of grounding pads 135 are formed on a lower edge of the main portion 132 for soldering to the circuit board. A number of locking tabs 136 are provided on the side portion 131 for being embedded within grooves 117 defined on the opposite end walls 114, thus securely fixing the shielding plates 13 to the housing 11. The side portions 131 further has a number of dimples 137 protruding inwardly for contacting with the shielding plates 23 of the plug connector 2.

The side portions 131 of the shielding plates 13 may extend along the end walls 114 of the housing 11 to the extent that the side portions 131 could contact with each other. It should be noted that the shielding plates 13 may be made in a single piece.

Figure 6:
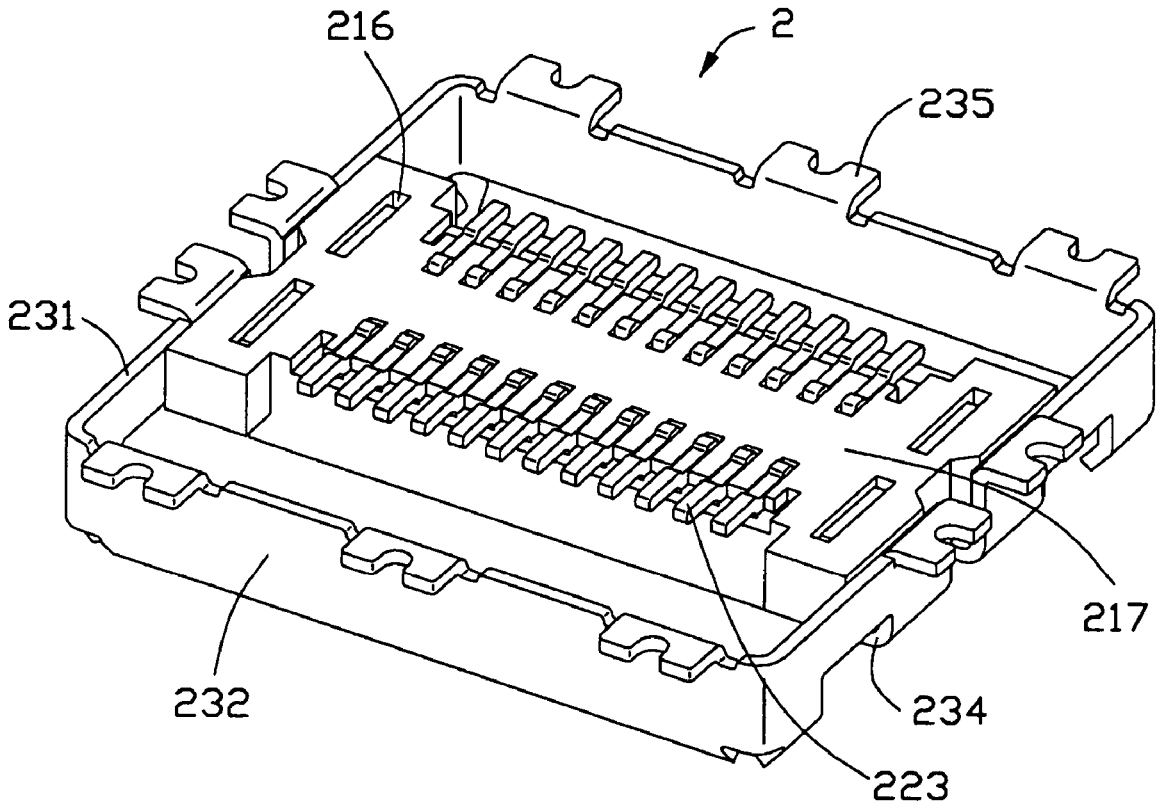
FIG. 6 is an assembled perspective view of the plug connector of FIG. 5 taken from another aspect.

Referring to FIGS. 4, 6 and 8, the plug connector 2 consists of an insulative housing 21 and two rows of contacts 22 longitudinally arranged in the housing 21 at regular interval. The housing 21 comprises two parallel long side walls 211 connected by two parallel end walls 212 and defines an elongated opening 213 for engaging the receptacle connector 1. The side walls 211 define a plurality of slots 214 communicating with the opening 213, a number of grooves 216 are provided on the end portions 212 for fixing shielding plates 23 to the housing 21.

Each of the contacts 22 has a contacting section 221 disposed within the slots 214 of the insulative housing 21 for contacting with contacts 12 of the receptacle connector 1, a base portion 223 and a retaining portion 222 projecting upwardly from a substantially middle portion of the base portion 223. The contacting section 221 has a projection 220 extending outwardly form an upper end thereof for resist accidental unmating of the receptacle connector 1 from the plug connector 2. A barb 225 is formed on one edge of the retaining portion 222. It should be noted that the contacts 22 may be fixed to the side walls 211 of the housing 21 by insert molding in the housing 21. Tail ends 224 of the base portions 223 extend outside the side walls 211 of the insulative housing 21 for surface mounting on the circuit board.

A pair of shielding plates 23 attached to the housing 21 has a base portion 232 parallel to the side walls 211 of the housing 21 and a bent portion 231 connected to the base portion 232. The shielding plates 23 further include a number of inclined tabs 233 projecting inwardly from an upper edge thereof. During the receptacle connector 1 mating with the plug connector 2, the inclined tabs 233 and the lead-in tabs 133 can perform a lead-in function to guide the plug connector 2 into engagement with the receptacle connector 1. The base portion 232 and the bent portion 231 further include a number of grounding pads 235 extending horizontially from a lower edge thereof for mounting on the circuit board. The bent portion 231 has a number of locking tab 234 extending laterally and downwardly from upper edges thereof. A pair of barbs 236 are formed on opposite edges of the locking tab 234 for engaging within the grooves 216 in each end wall 212 of the housing 21. Understandably, the shielding plates 23 may be made in one piece as a whole.

Figure 7:
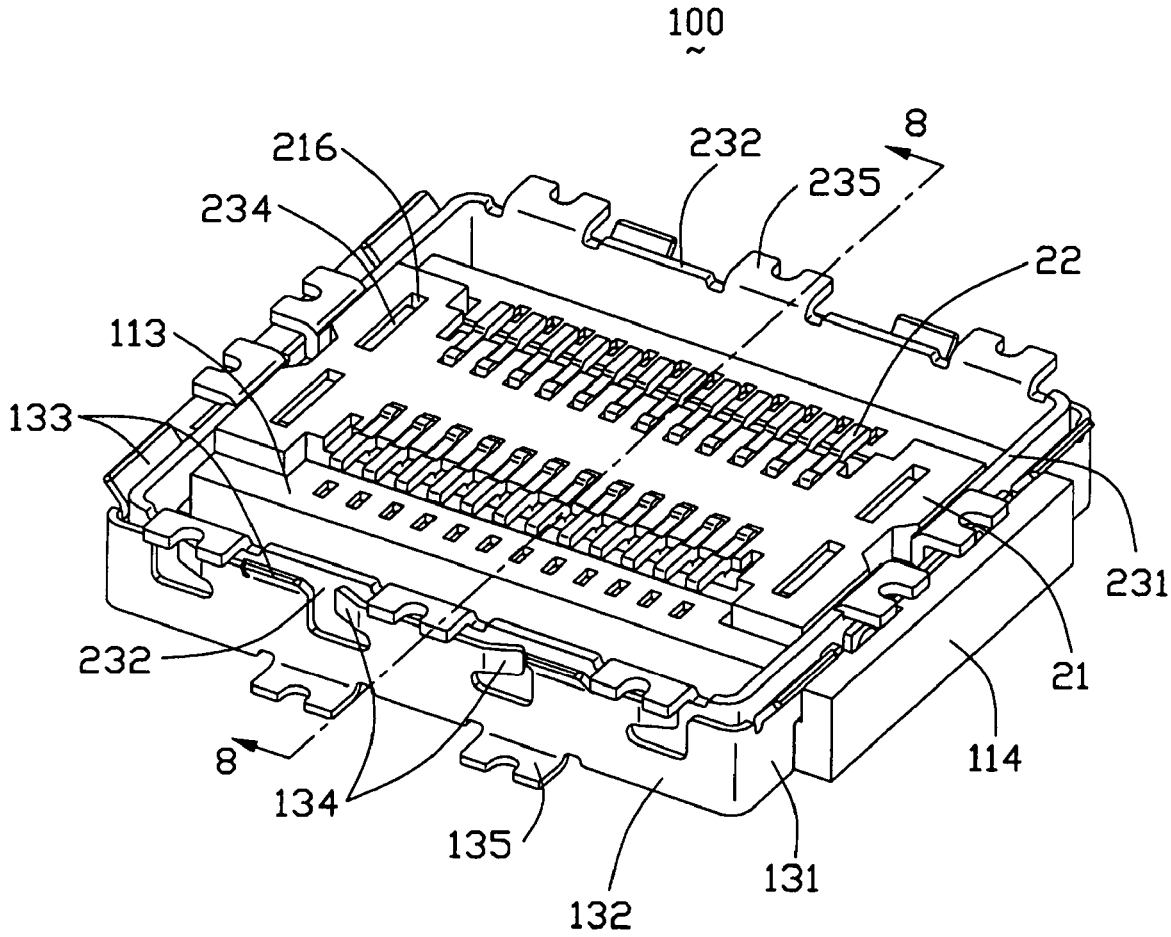
FIG. 7 is an assembled perspective view of an electrical connector assembly showing the plug connector mating with the receptacle connector.

Referring to FIGS. 7–8, when the receptacle connector 1 and the plug connector 2 are mated together, the free ends 120 of receptacle contacts 12 frictionally engage the contacting sections 221 of the plug contacts 22 to provide electrical connection and mechanical retention force. The resilient fingers 134 contact with the base portion 232 of the shielding plates 23 in the plug connector 2, the dimples 137 contact with bent portions 231 of the shielding plates 23, in this arrangement, superior shielding characteristics of the electrical connector assembly 100 is obtained by establishing connections between different portions of the shielding plates 13 of the receptacle connector 1 and the shielding plates 23 of the plug connector 2.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly for connecting a first and a second circuit boards, comprising:

a plug connector mounted on the first circuit board, comprising:

a first insulative housing having a mounting face, a mating face, side walls and a number of contact receiving slots therethrough in the side walls;

a plurality of first contacts received in the contact receiving slots, each first contact having a soldering portion extending along said mounting face for surface mounting on said first circuit board in a first direction;

a pair of first shielding plates attached to the housing, each shielding plate having a main portion located outside the soldering portion and extending in a second direction perpendicular to said first direction, and a grounding pad extending along said mounting face for surface mounting on said first circuit board;

a receptacle connector mounted on the second circuit board, comprising:

a second insulative housing defining a mounting face, a mating face, side walls and a number of contact receiving slots therethrough in the side walls;

a plurality of second contacts received in the contact receiving slots, each second contact having a soldering portion extending along said mounting face for surface mounting on said second circuit board in said first direction;

a pair of second shielding plates attached to said second housing and contacting with the first shielding plates, and having a main portion disposed outside the soldering portion of the second contact and extending in said second direction, and a grounding pad extending along said mounting face for surface mounting on said second circuit board wherein said first shielding plate has an inclined tab extending inwardly from an upper edge thereof, said second shielding plate has a lead-in tab extending outwardly form an upper edge thereof and cooperating with the inclined tab for easing the insertion of the plug connector into the receptacle connector;

wherein the first housing and second housing having a number of grooves respectively, the shielding plate both in the plug and the receptacle connector defining a pair of locking tab opposing each other and provided with barbs on opposite edges thereof for interference engagement with the grooves respectively.

2. The electrical connector assembly as described in claim 1, wherein the second shielding plate further has a number of resilient fingers and dimples both protruding inwardly from an upper edge thereof for contacting with the first shielding plates in both the first direction and the second direction.

3. The electrical connector assembly as described in claim 1, wherein the shielding plate both in the plug and the receptacle connector defines a pair of side portions bent from opposite ends of the main portion and extending in the first direction to the extent that shielding plates either in the plug or the receptacle connector contact with each other respectively.

4. An electrical connector for mounting on a circuit board, comprising:

an insulative housing having a pair of side walls, each of the side walls having a plurality of contact receiving slots and mounting holes, a pair of end walls connected to said side walls and defining a mating opening for accommodating a mating electrical connector having a mounting face, a mating face and a number of contact receiving slots;

a plurality of contacts received in the contact receiving slots and the mounting holes of the side walls of the insulative housing and each of the contacts having a soldering portion extending along said mounting face for surface mounting on the circuit board;

a pair of shielding plates each having a main portion being located outside tail ends of the soldering portion, a bent portion bent from opposite ends of the main potion and attached to the end walls, and a grounding pad extending horizontally from a lower edge of said main portion along said mounting face for surface mounting on said first circuit board wherein the end walls have a number of grooves, the bent portions each defines a pair of locking tabs on a lower edge thereof for interference engagement with the grooves;

wherein the housing further includes a central portion connected to end walls and dividing the mating opening into two pieces.

5. The electrical connector as described in claim 4, wherein the shielding plate has a lead-in tab on an upper edge thereof for facilitating engagement with the mating electrical connector.

* * * * *